US012545466B2

(12) United States Patent
Wetsch et al.

(10) Patent No.: US 12,545,466 B2
(45) Date of Patent: Feb. 10, 2026

(54) PRODUCT PACKAGING USING COMPUTER VISION AND ADAPTIVE PACKAGING SELECTION

(71) Applicant: Pregis LLC, Chicago, IL (US)

(72) Inventors: Thomas D. Wetsch, Naples, FL (US); Ken Chess, Hinsdale, IL (US); David Schuda, Wheaton, IL (US)

(73) Assignee: Pregis LLC, Chicago, IL (US)

( * ) Notice: Subject to any disclaimer, the term of this patent is extended or adjusted under 35 U.S.C. 154(b) by 33 days.

(21) Appl. No.: 18/592,923

(22) Filed: Mar. 1, 2024

(65) Prior Publication Data

US 2024/0294293 A1 Sep. 5, 2024

Related U.S. Application Data

(60) Provisional application No. 63/488,023, filed on Mar. 2, 2023.

(51) Int. Cl.
*B65B 57/12* (2006.01)
*B65B 55/20* (2006.01)

(52) U.S. Cl.
CPC ..... *B65B 57/12* (2013.01); *B65B 55/20* (2013.01)

(58) Field of Classification Search
None
See application file for complete search history.

(56) References Cited

U.S. PATENT DOCUMENTS

| | | | | |
|---|---|---|---|---|
| 7,814,733 | B2 | 10/2010 | Carlson et al. | |
| 8,997,440 | B2 | 4/2015 | Carlson et al. | |
| 9,102,429 | B2 | 8/2015 | Corradi et al. | |
| 9,994,346 | B2 | 6/2018 | Carlson et al. | |
| 10,227,171 | B2 | 3/2019 | Wetsch et al. | |
| 10,233,005 | B1 | 3/2019 | De Bonet | |
| 10,518,919 | B2 | 12/2019 | Cheich et al. | |
| 2008/0092488 | A1* | 4/2008 | Gabrielsen | B65B 55/20 53/115 |
| 2011/0308204 | A1* | 12/2011 | Corradi | B65B 57/14 53/115 |
| 2017/0183139 | A1* | 6/2017 | Wetsch | B65B 57/12 |
| 2023/0067806 | A1* | 3/2023 | Brandsetter | B65B 55/20 |

FOREIGN PATENT DOCUMENTS

EP 2370319 B1 1/2014

* cited by examiner

*Primary Examiner* — Chinyere J Rushing-Tucker
(74) *Attorney, Agent, or Firm* — Fox Rothschild LLP

(57) ABSTRACT

Systems and methods for packing a shipping container. The methods comprise: detecting, by a computing device, a presence of the shipping container; generating, by a computing device, a 3D point cloud comprising a 3D perspective representation of interior of the shipping container and surfaces of at least one item disposed in the shipping container; analyzing, by a computing device, the 3D point cloud to identify a void area inside the shipping container, the void area being absent of the at least one item; selecting, by the computing device, a percentage from a plurality of possible percentages based on a characteristic of the void area; and causing, by the computing device, protective packaging to be dispensed into the void area such that the selected percentage of the void area is filled with the protective packaging.

25 Claims, 7 Drawing Sheets

PRODUCT PACKAGING USING COMPUTER VISION AND ADAPTIVE PACKAGING SELECTION

CROSS-REFERENCE TO RELATED APPLICATIONS

The present application claims priority to and the benefit of U.S. Provisional Patent Application No. 63/488,023 which was filed on Mar. 2, 2023. The contents of this U.S. Provisional patent application are incorporated herein by reference in its entirety.

BACKGROUND

Description of the Related Art

When a product is purchased online, it is packaged and sent to the purchaser via parcel delivery service. Products are often sent in either flexible mailer or a box that is lined and/or filled with protective-packaging. The protective-packing can include, for example, bubble wrap, packing paper dunnage, biodegradable packing peanuts, foam, corrugated dunnage, and/or inflatable cushions (or pillows). An individual places the product(s) in the box, obtains the protective packaging, fills the box with the protective packaging, and seals the box for shipping. Known processes use human assistance throughout the box filling/sealing process.

SUMMARY

The present disclosure concerns a method for packing a shipping container. The method comprises: detecting, by a computing device, a presence of the shipping container; generating, by a computing device, a 3D point cloud comprising a 3D perspective representation of interior of the shipping container and surfaces of at least one item disposed in the shipping container; analyzing, by a computing device, the 3D point cloud to identify a void area inside the shipping container, the void area being absent of the at least one item; selecting, by the computing device, a percentage from a plurality of possible percentages based on a characteristic of the void area; and causing, by the computing device, protective packaging to be dispensed into the void area such that the selected percentage of the void area is filled with the protective packaging.

The present disclosure also concerns a system. The system comprises: a processor; and a non-transitory computer-readable storage medium comprising programming instructions that are configured to cause the processor to implement a method for packing a shipping container. The programming instructions comprise instructions to: detect presence of the shipping container; generate a 3D point cloud comprising a 3D perspective representation of interior of the shipping container and surfaces of at least one item disposed in the shipping container; analyze the 3D point cloud to identify a void area inside the shipping container, the void area being absent of the at least one item; select a percentage from a plurality of possible percentages based on a characteristic of the void area; and cause protective packaging to be dispensed into the void area such that the selected percentage of the void area is filled with protective packaging.

The present disclosure further concerns a non-transitory computer-readable medium that stores instructions that, when executed by at least one computing device, will cause the at least one computing device to perform operations. These operations comprise: detecting a presence of the shipping container; generating a 3D point cloud comprising a 3D perspective representation of interior of the shipping container and surfaces of at least one item disposed in the shipping container; analyzing the 3D point cloud to identify a void area inside the shipping container, the void area being absent of the at least one item; selecting a percentage from a plurality of possible percentages based on a characteristic of the void area; and causing protective packaging to be dispensed into the void area such that the selected percentage of the void area is filled with protective packaging.

BRIEF DESCRIPTION OF THE DRAWINGS

The present solution will be described with reference to the following drawing figures, in which like numerals represent like items throughout the figures.

DETAILED DESCRIPTION

Figure 1:
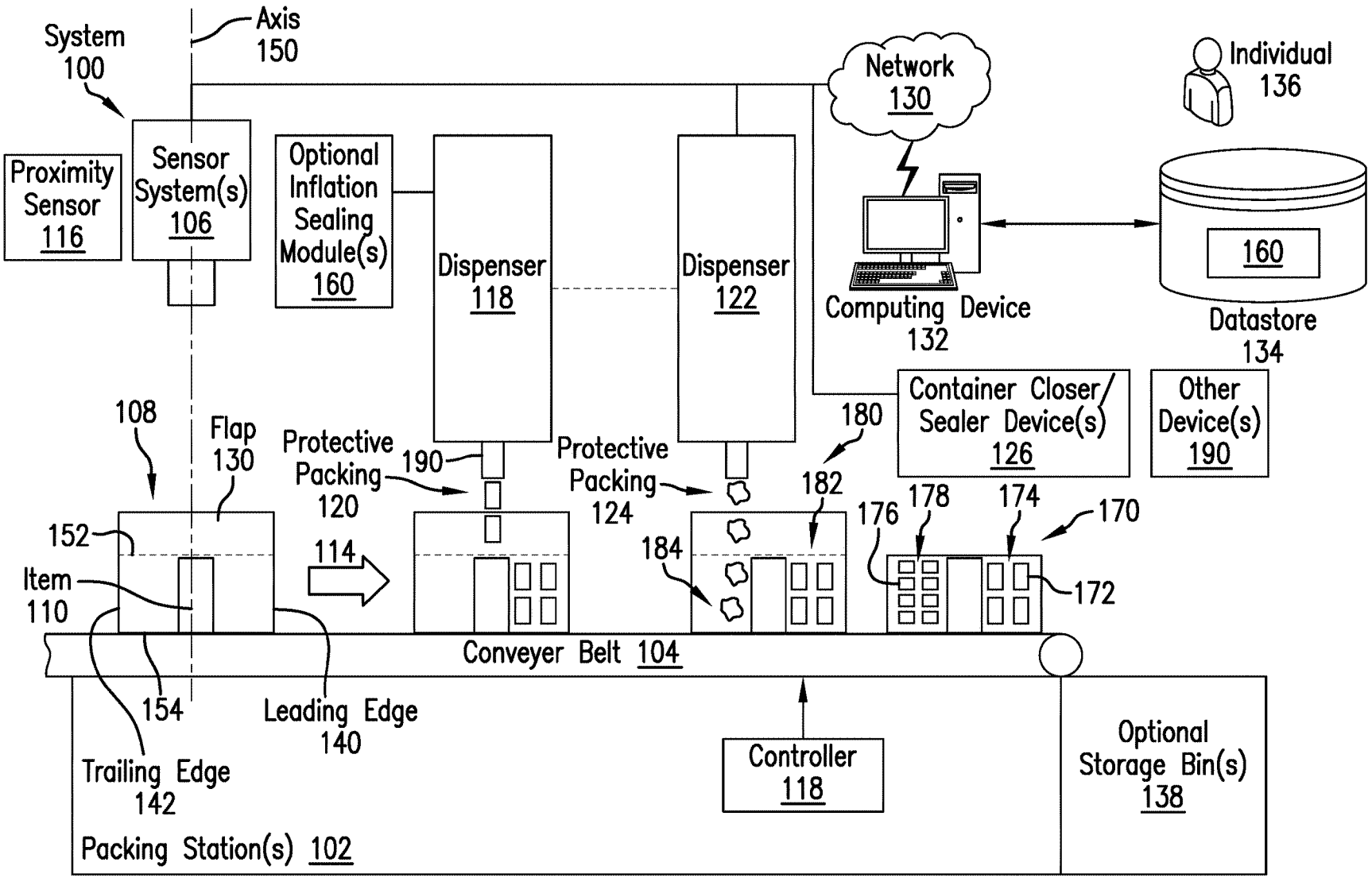
FIG. 1 provides an illustration of an illustrative system.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present solution may be embodied in other specific forms without departing from its spirit or essential characteristics. The described embodiments are to be considered in all respects only as illustrative and not restrictive. The scope of the present solution is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present solution should be or are in any single embodiment of the present solution. Rather, language referring to the features and advantages is understood to mean that a specific feature, advantage, or characteristic described in connection with an embodiment is included in at least one embodiment of the present solution. Thus, discussions of the features and advantages, and similar language, throughout the specification may, but do not necessarily, refer to the same embodiment.

Furthermore, the described features, advantages and characteristics of the present solution may be combined in any suitable manner in one or more embodiments. One skilled in the relevant art will recognize, in light of the description herein, that the present solution can be practiced without one or more of the specific features or advantages of a particular embodiment. In other instances, additional features and advantages may be recognized in certain embodiments that may not be present in all embodiments of the present solution.

Reference throughout this specification to "one embodiment", "an embodiment", or similar language means that a particular feature, structure, or characteristic described in connection with the indicated embodiment is included in at least one embodiment of the present solution. Thus, the phrases "in one embodiment", "in an embodiment", and similar language throughout this specification may, but do not necessarily, all refer to the same embodiment.

As used in this document, the singular form "a", "an", and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to".

As noted above, products purchased online are packaged and sent to the purchaser via parcel delivery service. Products are often sent in either flexible mailer or a box that is lined and/or filled with protective-packaging. The protective-packing can include cushioning or void fill, for example, bubble wrap, packing paper dunnage, foam and/or inflatable cushions (or pillows). An individual or mechanical robot can pick and place the product(s) into the selected box or mailer. This is then followed by obtaining the proper protective packaging to wrap or fill voids in the box to take up space and protect the product(s) for shipment. Known processes use human assistance throughout the picking, box or mailer selection, sorting products for orders and decision making on the type of interior packaging along with the box or style of mailer prior to the filling/sealing process.

In distribution centers, there is a need for a way to package consumer purchased products at high speed with a limited amount of human assistance or without a requirement for any human assistance. Accordingly, the conventional solutions are labor intensive, independent and not connected where it creates more human inputs using more packaging or the wrong type of packaging to protect the products. The present solution described herein provides automated or semi-automated ways for items to be recognized and packaged with protective packaging articles to be sent to destinations on a relatively large scale. The automation or semi-automation reduced the cost, amount of required labor, and amount of human error.

The product or products are configured for placement within a packaging container or between packaging containers or items being shipped or stored, to protect items, fill void space within a container, such as a packaging container, and/or prevent or inhibit the items from moving around within the packaging container. While there is overlap between the following categories, example categories of protective packaging articles include protective-fill articles, and block-and-brace articles.

Protective-fill articles are typically provided individually or as a plurality of units that are configured for placing into the void space to provide a desired level of packaging. Such units typically are of a predetermined size, or can have a predetermined dimensions and be selectively configurable in another dimension, such as length. In some examples, the size of the protective-fill articles can be configurable in a plurality or all of their dimensions. Protective-fill articles are typically resiliently flexible to compressible fit in around corners, edges, and sides of a packaged item to fill or cushion item(s) within the space around the item, instead of assuming a solid shape that corresponds to the space around the item. Protective-fill articles include, for example, void-fill articles and cushioning articles.

Void-fill articles typically provide minimal cushioning properties and are relatively soft. They are typically used to fill empty void space in packaging containers to reduce the movement within the container of lightweight items that are or could be fragile or susceptible to damage inside of the box or where multiple products are put into the box prevent interior movement that can damage the items such as a glass jar. An example of void-fill article includes crumpled-paper dunnage with a fairly light compression loft pattern and other space fillers that are easily compressible.

Cushioning articles are configured to provide cushioning to the packaged items and protection at various degrees against shocks and impacts which can be up to 20-30 during an average shipping cycle. Examples of cushioning materials include inflatable air pillows and cushions, bubble wrap, paper dunnage with a loft structure capable of withstanding moderate shocks and impact, foam sheets, and packing peanuts. Typically, both void-fill and cushioning articles are provided as a plurality of units of one or more similar sizes, typically common predetermined sizes, although in some applications the void fill or cushioning articles of other protective fill can be made to custom sizes.

The plurality of void-fill or cushioning articles that are used is typically selected to sufficiently fill the void space by dispensing a length of material to place within the container to serve the desired protective function. Some void-fill or cushioning articles can be used to enclose or otherwise surround an item, such as expandable-paper or bubble wrap that can be used to wrap an item, such as a bottle, jar or fragile item.

Multiple systems are used to speed up the packaging process and reduce waste by optimizing the amount of protective packaging (e.g., inflatable cushion) used to fill each shipping container (e.g., a box). Conventional systems comprise mostly human determinations based on what they are packaging and some guessing at the right box, amount of packaging and proper use of packaging should be applied. In some cases, cameras have been used to try and improve in quality as the price goes down over the years. In the present solution, machine learning can allow cameras and other sensors to: detect when a shipping container is in proximity to the dispensing system; automatedly compute the size of the detected shipping container; detect when a center of the shipping container is aligned with a dispenser through the use of a camera or other sensor; generate a 2D image from the top of the carton to identify portions of the contents of the shipping container; identify an area inside the shipping container that is void or absent of any object or item; compute the volume of the identified void area; optionally segment the void area; communicate to a timer that will dispense some protective packaging to fill the void area or each void area section (e.g., based on the size of the void area, the size of the void area section and/or the type of product disposed in the shipping container); and/or control a dispenser to dispense the protective-packaging into the shipping container.

The present solution will now be described in relation to the packaging of purchased items. The present solution can also be used in other applications when an object needs to be delivered from a start location to a destination location.

FIG. 1 provides an illustration of a system 100 generally configured to facilitate the packaging and shipping of items 110. The items can include various products and could include perishable items (e.g., food) and/or non-perishable items (e.g., apparel, appliances, automotive parts, beauty supplies, personal care items, books, consumer electronics, entertainment tickets, fashion accessories, footwear, office supplies, sports equipment, toys, video games, watches, glasses and/or jewelry).

System 100 comprises packing station(s) 102, sensor system(s) 106, optional inflation module(s) 160, dispenser(s) 118, 122, and container closer/sealer device(s) 126. These components are communicatively coupled to each other and to one or more computing devices 132 via a network 130 (e.g., the Internet or Intranet). Each packing station 102 includes a conveyer belt 104 which is controlled by controller 190. Any known or to be known conveyer belt and controller can be used herein. Optional storage bin(s) may be provided at the end of the conveyer belt 104 for temporary storage of the sealed shipping containers and/or transport to a sorting/shipping station.

As shown in FIG. 1, a sensor system 106 is placed at a location relatively close to the packing station 102 that is suitable for generating sensor data relating to shipping container contents 108, 170, 180 that are being moved by the conveyer belt 104 towards dispenser(s) 118, 122. The shipping containers 108, 170, 180 each have one or more items 110 disposed therein that may or may not need to be protected from damage during shipping by protective-packaging dispensed by the dispenser(s) 118, 122. The shipping containers can include, but are not limited to, shipping boxes, shipping bags, and/or shipping envelopes. The sensor system 106 can include, but is not limited to, monocular camera(s), digital camera(s), radar sensor(s), lidar sensor(s), Time Of Flight (ToF) camera(s), and/or other sensor device(s). More than one sensor type may be used in conjunction to create additional data or to confirm the point cloud accuracy, particularly with opaque or reflective surfaces.

The dispenser(s) 118, 122 can have any suitable configuration to produce desired types of protective-fill. For example, the dispenser(s) 118, 122 may be configured to convert supply material into protective packaging-material. In this case, the dispenser(s) 118, 122 could comprise paper-dunnage machine(s), inflation and sealing device(s), and/or foam-in-bag device(s). Alternatively, the dispenser(s) 118, 122 simply may dispense protective-packaging elements therefrom. In this case, the dispenser(s) 118, 122 could store and dispense packing peanuts, discrete lengths of bubble wrap, discrete lengths of paper dunnage, and/or other types of protective packaging elements. The dispenser(s) 118, 122 may comprise a cutting mechanism for cutting pieces of bubble wrap and/or paper dunnage from rolls stored therein. In other scenarios, the dispenser(s) 118, 122 are coupled to external devices which supply the protective packaging to be dispensed by the dispenser(s) 118, 122. The external devices can include, but are not limited to, inflation sealing module(s).

The inflation module(s) 160 is(are) configured to inflate inflatable protective-packaging such as cushions, pillows and bladders. The inflated protective-packaging is then provided to dispenser 118 for storage and dispensing into shipping containers as they pass thereunder. A single dispenser 118 can be provided in system 100. Alternatively, two or more dispensers 118, 122 can be provided in system 100 which are configured to dispense the same protective-packaging or different types of protective-packaging depending on the required protection. For example, a first dispenser 118 can dispense inflated cushions, while a second dispenser 122 can dispense paper dunnage. The inflation module(s) 160 and/or dispenser(s) 118, 122 can be manually controlled by an individual 136 or autonomously controlled by computing device 132. The present solution will be discussed below in the autonomous controlled context.

As a shipping container 108 is moving on the conveyer belt 104 in direction 114, a proximity sensor 116 detects when the shipping container 108 comes in proximity to the sensor system 106. The proximity sensor 116 can include, but is not limited to, a beam brake sensor, a scanner (e.g., barcode scanner), and/or a camera. The sensor system 106 can generate sensor data continuously or periodically in response to trigger events. A trigger event can include, but is not limited to, an alignment of a center of the shipping container 108 with an axis 150 of the sensor system 106. Shipping container 108 is shown in FIG. 1 as comprising a shipping box. As noted above, the shipping container can alternatively comprise, for example, a shipping bag or a shipping envelope.

In some scenarios, the system 100 performs operations to detect when the center of the shipping container is aligned with the axis 150 of the sensor system 106. This can be accomplished, for example, using a sensor device of the sensor system 106 and the computing device 132. A first sensor device generates depth measurements. The computing device 132 uses the depth measurements to detect a leading edge 140 and a trailing edge 142 of the shipping container as it moves in direction 114 on a conveyer belt. Each edge 140, 142 of the shipping container 108 is detected when a depth measurement is less the threshold value thr. The threshold value thr may be selected based on the known distance between the sensor system 106 and the conveyer system 104 and the known heights of shipping container sidewalls (with the flanges extended in upward direction, i.e., the flanges (or flaps) have not yet been bent at the score (or seams) 152). Additional alternative sensors can be added to identify the score (152) in the box where the flaps fold to close the box and can achieve the depth measurement by recognition of the score that will determine the flap (flange) length or determine ultimately the box depth. These two edge detections are then used to determine the length L of the shipping container 108 (which extends in the direction of travel 114 of the conveyer belt). The shipping container length L, edge detection timing and known conveyer speed S are used to identify a time t when the shipping container's center is aligned with axis 150. The conveyer belt 104 may optionally be controlled by controller 190 to either (i) continuously move the shipping container 108 in direction 114 at a given speed or (ii) cause the shipping container 108 to temporarily come to a stop when its center is aligned with axis 150. In scenario (i), an encoder may be employed on the moving conveyance in order to correlate the void sampling with that axis of motion.

At time t, a second sensor device of the sensor system 106 is enabled or otherwise activated to generate sensor data useful in producing a 3D point cloud of an internal cavity of the shipping container 108. The 3D point cloud comprises a plurality of points plotted on a 3D graph to provide a 3D surface map of the interior sidewall surfaces of the shipping container 108 and/or exposed surfaces of any objects disposed inside the shipping container. Thus, each point has an x-coordinate, a y-coordinate and a z-coordinate.

The computing device 132 analyzes the 3D point cloud and other sensor data to identify one or more areas inside the shipping container 108 that (i) are located below the flap seams (or scores) 152 and (ii) are void or otherwise absent of any object(s). The identified area(s) is(are) referred to herein as void area(s). In some scenarios, the shipping container's flaps and a filtered outline around the shipping container define the shipping container footprint geometry, and with automated depth measurement the computing device 132 is able to determine the empty volume of the shipping container 108. From the topography of the contents and this empty shipping container volume, the remaining space may be calculated as void. A still image with the 3D point cloud allows for a machine-vision to verify the true nature of the contents of the shipping container 108, especially shiny objects, clear or opaque films, etc.

In other scenarios, the void area may be determined in another way. The height H of the shipping container 108 in its fully packaged state extends vertically from the box's bottom edge 154 to the flap seam (or score) 152. This height H may be computed in a variety of ways and/or obtained from a datastore 134. For example, the height H may be computed based on the depth measurement associated with the leading or trailing edge 140, 142 of the shipping container 108. This depth measurement specifies a height h of an upper edge of a flap relative to the top surface of the conveyer belt, the sensor device or other reference point. H may be determined by dividing h by N (i.e., H=h/N) or multiplying h by N, where N is any number greater than zero (e.g., 2). The ratio of h to H is known. The total internal volume of the box 108 can then be computed using the length L, height H and width W. The width W is determined from the 3D point cloud data and extends transverse to the direction of travel 114 of the conveyer belt.

The box dimensions may additionally or alternatively be known in the Warehouse Management System (WMS) or other facility management software. In this case, the box dimensions can be passed to the computing device when an identifier code is scanned, typically a bar code on the carton.

A cuboid or other 3D shape may then be generated that represents the 3D shipping container having these dimensions. The cuboid or other 3D shape may then be overlaid on the 3D graph such that (i) its center is aligned with the center of the shipping container 108 and (ii) its bottom surface is aligned with a known location of the top surface of the conveyer belt 104. Any points of the 3D point cloud which reside outside of the cuboid/3D shape may be discarded or otherwise filtered. The cuboid/3D shape and the remaining points of the 3D point cloud are then analyzed to identify one or more void areas inside the shipping container 108. The cubic volume V of each identified void area may be computed using known mathematical algorithms.

Upon identified void area(s), the computing device 132 may store information 160 in a datastore 134 that: identifies the shipping container 108; identifies each void area detected inside the shipping container 108; specifies the location of each void area inside the shipping container 108; specifies the cubic volume V of each void area; and/or specifies the type of each object disposed inside the shipping container 108. The object type can be determined in accordance with known or to be known object type detection techniques using 3D point clouds, scanner data (e.g., barcode data), machine vision, and/or accessible product data pulled from a 3D scanner used to size the product, a database with pre-programmed sizing or manually dimensioned products.

The computing device 132 may then determine whether the cubic volume V for each void area is large enough to be filled with at least a minimum amount of protective-packaging (e.g., a minimum number of inflatable cushions or a minimum length of paper dunnage, which may be measured in linear footage). If not, then the shipping container 108 may optionally be caused to travel towards the downstream container closer/sealer 126 without having any protective-packaging dispensed therein by dispenser(s) 118, 122.

If so, then the computing device 132 performs other operations to facilitate filling of the shipping container 108 with protective packaging article(s) 120, 124 by the dispenser(s) 118, 122. For each void area, the computing device 132 may select (i) a type of package material from a plurality of package material types and/or (ii) a percentage between 0%-100% based on the cubic volume V associated with the void area and/or the type of object disposed in the shipping container 108 below or adjacent to the void area. For example, the computing device 132 selects paper dunnage and 60% when the cubic volume V has a first value and the type of object is a blanket, and alternatively selects inflatable cushion (or pillow) and 95% when the volume has a second value and the type of object is glassware. The percentage represents a minimum amount of the void area that should be filled with protective packaging.

Figure 4:
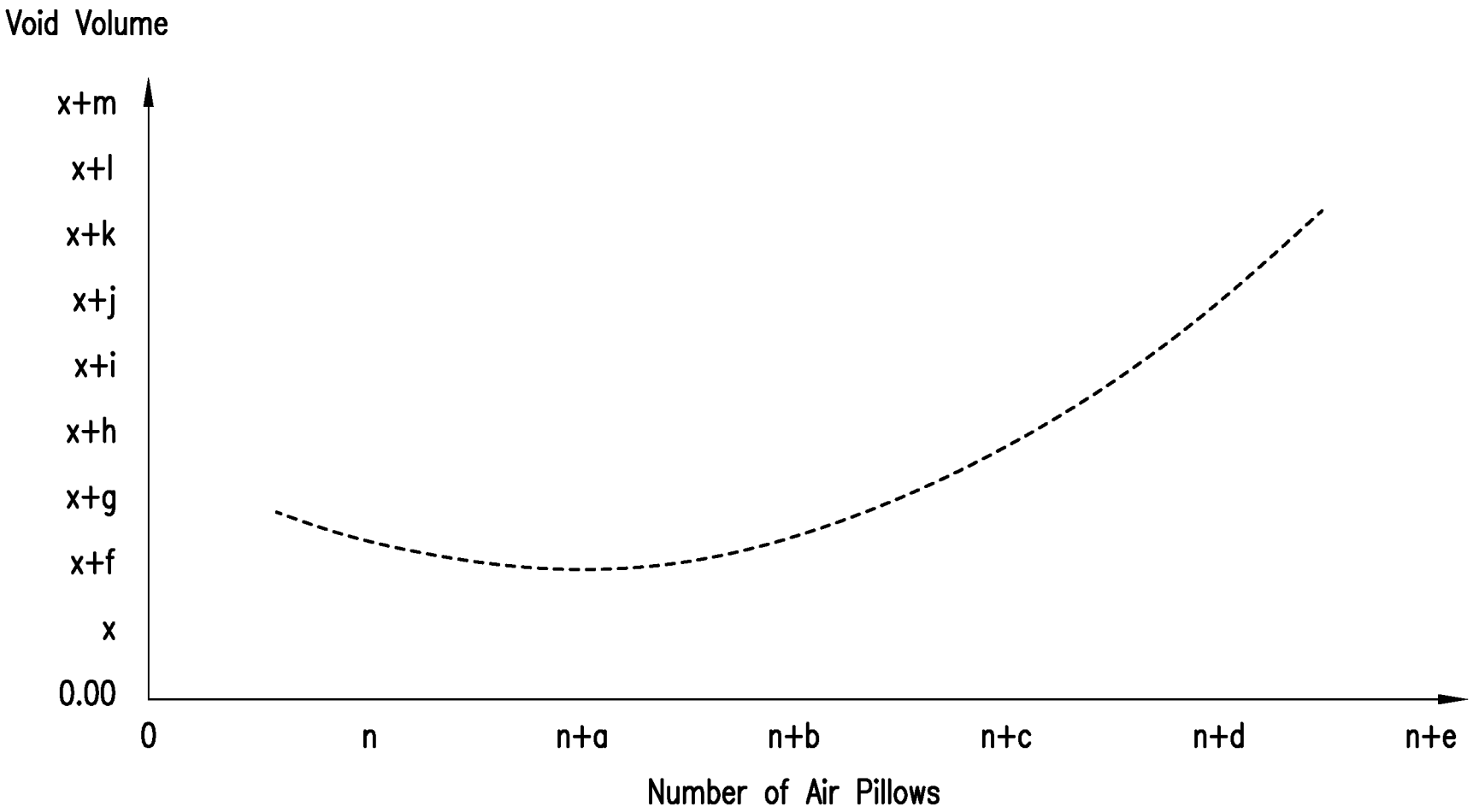
FIG. 4 provide a graph showing a non-linear relationship between void area cubic volume and number of inflatable cushions to be used to fill the same.

The relationship between void area's cubic volume V and percentage of the void area that should be filled with a protective packaging may be non-linear. A graph showing an illustrative non-linear relationship is provided in FIG. 4. The non-linear relationship can be determined empirically based on collected information and/or a best curve fitting algorithm.

When an inflatable type of protective-packaging is selected, the computing device 132 may additionally determine the amount by which the protective-packaging should be inflated. For example, the computing device 132 previously determined that inflatable cushions of a given size (e.g., 5×8 inches in its uninflated state) should be used to fill the box 108. The computing device 132 then accesses, for example, a Look-Up Table (LUT) to obtain the amount of inflation for the inflatable cushions such that at least 75% of a void area inside the box will be filled thereby. The LUT can be indexed by an identifier for the cushions of the given size, an identifier for the type of object disposed in the shipping container, a shipping container type (e.g., box), shipping container dimensions (i.e., L, W, H), and/or the percentage of the void area that should be filled by the cushions. The LUT can identify different amounts of inflation for different types of objects, different sizes of cushions, different types of shipping containers, different sizes of shipping containers, and/or different fill percentages.

When packaging paper dunnage is selected, the computing device 132 may additionally determine whether the paper dunnage should be stacked, folded (e.g., accordion folded), loosely rolled, tightly rolled, loosely crumpled or tightly crumpled. For example, the computing device 132 previously determined that discretely sized pieces of paper dunnage should be used to fill the box 108. The computing device 132 then accesses, for example, a LUT to obtain information indicating that the paper should be crumpled loosely or tightly. The LUT can be indexed by an identifier for the paper dunnage of a discrete size, an identifier for the type of object disposed in the shipping container, a shipping container type (e.g., box), shipping container dimensions (i.e., L, W, H), and/or the percentage of the void area that should be filled by the paper dunnage. The LUT can identify different types or amounts of crumpling for different types of objects, different discrete sizes of paper dunnage, different types of shipping containers, different sizes of shipping containers, and/or different fill percentages.

Next, the computing device 132 provides information to the inflation module(s) 160 and/or dispenser(s) 118, 122 that is useful for filling the shipping container 108 with the selected parameters. This information can include, but is not limited to, void area identifiers, void area locations in the shipping container (e.g., quadrant identifiers), type of protective-packaging (e.g., inflatable cushion or paper dunnage) to be used in each void area, number of protective-packaging units (e.g., 10 cushions or 20 discretely sized pieces of paper dunnage) for each void area, amount of protective packaging (e.g., 18 feet of paper dunnage per cubic foot) for each void area, amount of inflation, type of paper or dunnage folding (e.g., accordion), type of paper or dunnage rolling (e.g., loose or tight), and/or type of crumpling (e.g., loose or tight). In some scenarios, a large void area could be segmented into two or more void area sections of the same or different sizes. Thus, this information can also include void area section identifiers and locations inside the shipping container. The same or different type of protective-packaging can be used in the void area and/or void area sections. For example, a large inflatable cushion 172 is used in a first quadrant void area 174 inside a shipping container 170 and a small inflatable cushion 176 is used in a second quadrant void area 178 inside the shipping container. Alternatively, inflatable cushions 120 are used in a first quadrant void area 182 inside a shipping container 180 and crumpled paper dunnage 124 is used in a second quadrant void area 184 inside a shipping container.

The protective-packaging can be inserted into the shipping containers manually by individual 136 or automatedly by dispenser(s) 118, 122. In the latter case, the computing device 132 is configured to control operations of the inflation module(s) 160 and/or dispenser(s) 118, 122. Any known or to be known inflation module for inflating packaging cushions, pillows and/or bladders can be used herein. Also, any known or to be known dispenser can be used herein. In some scenarios, the dispenser is modified specifically to move the dispensing head 190 along multiple axes (e.g., an x-axis, a y-axis and/or a z-axis), rotationally or at an angle so that the shipping material is dispensed in a plurality of void areas and/or a plurality of void area sections (e.g., quadrant sections) in accordance with instructions received from the computing device 132.

Once the shipping container has been filled with protective-packaging, it is closed and sealed at block 126. Any known or to be known container closer/sealer device can be used herein. In some scenarios, the container closer/sealer device comprises one or more articulating arms with grippers at distal ends thereof and controllable joints along their elongate arms. Articulating arms and controller therefore are well known. If the shipping container is a box, then the flaps 130 are bent at the seams 152 and coupled together (e.g., via tape, a PSA or cold adhesive and/or staples). Other devices 190 may be provided downstream from the container closer/sealer device(s) 126. The other devices can include, but are not limited to, a labeling device that applied one or more labels to the shipping container 200.

Figure 2:
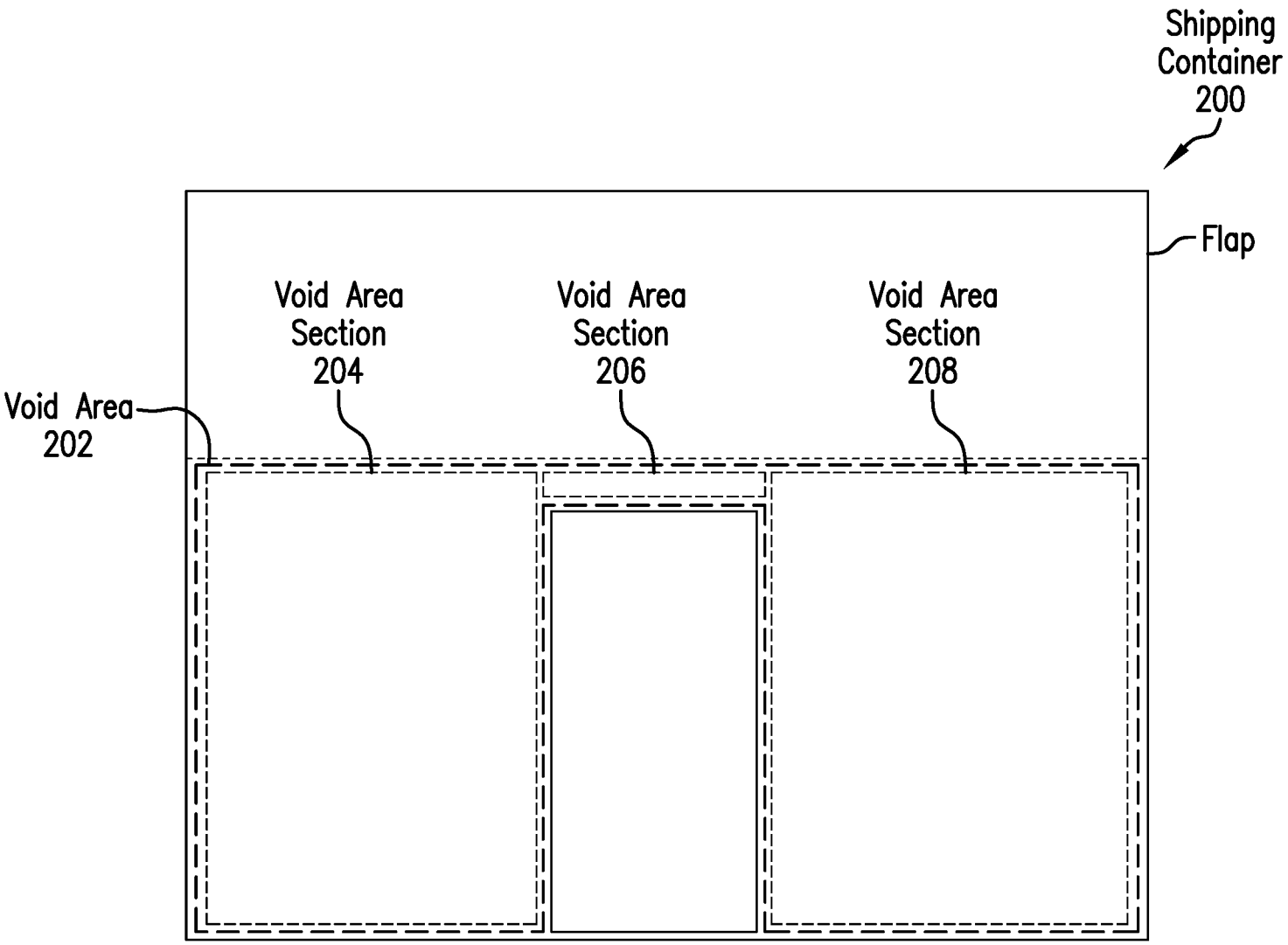
FIGS. 2-3 each provides an illustration of a shipping container comprising a void area which has been divided into void area sections.

As noted above, a void area may be segmented in some scenarios. FIG. 2 provides an illustration of a shipping container 200 comprising a void area 202 which has been divided into a plurality of void area sections 204, 206, 208. The same or different protective packaging can be dispensed into the void area sections 204, 206, 208. If the same inflatable protective packaging is to be used in the void area sections 204, 206, 208, then the same or different inflation amounts can be employed for each void area section 204, 206, 208. Other segmentation techniques can be used. For example, as shown by the top view of a shipping container 300 provided in FIG. 3, a void area can be segmented into quadrants resulting in four void area sections 304, 306, 308, 310.

Figure 3:
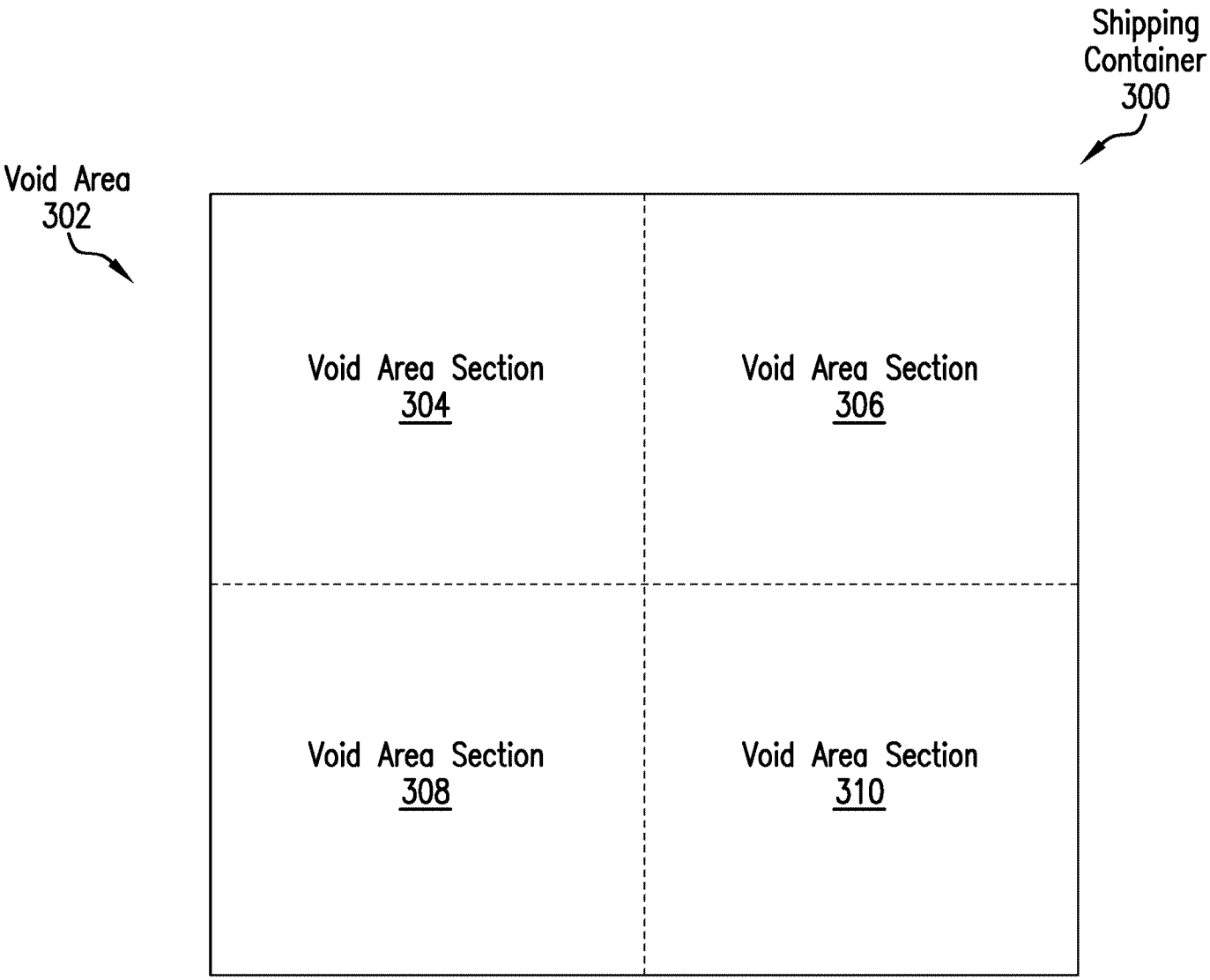
Figure 5A:
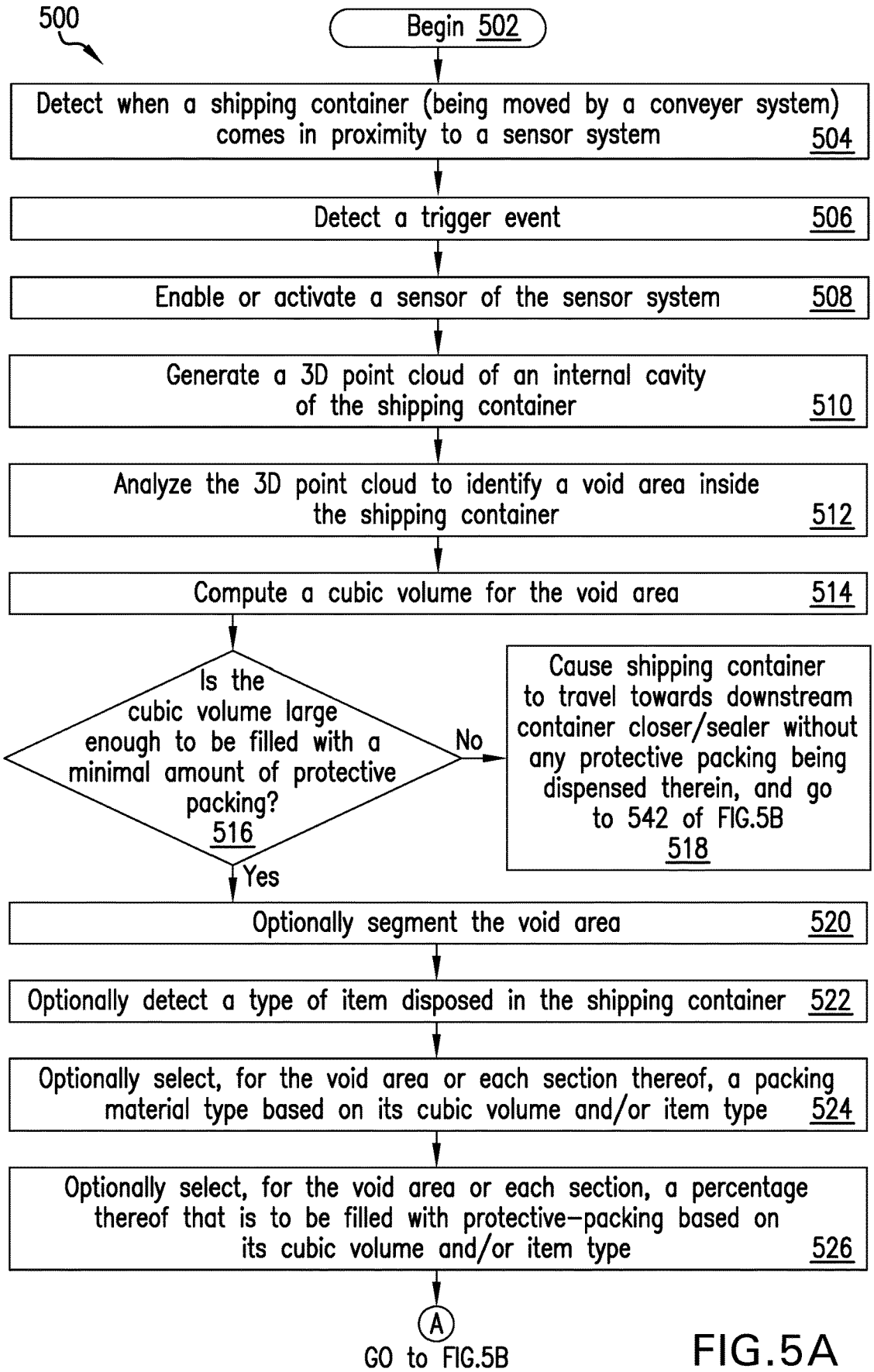
FIGS. 5A-5B (collectively referred to as "FIG. 5") provide a flow diagram of an illustration method for filling, closing and sealing a shipping container.

FIG. 5 provides a flow diagram of an illustrative method 500 for packaging item(s) (e.g., item 110 of FIG. 1) in a shipping container (e.g., shipping container 108 of FIG. 1, 170 of FIG. 1, 180 of FIG. 1, 200 of FIG. 2, or 300 of FIG. 3). Method 500 can include more or less operations than those shown in FIG. 5. Some or all of the operations of method 500 can be performed in the same or different order than that shown. Some or all of the operations of method 500 can be performed by a computing device (e.g., computing device 132 of FIGS. 1 and/or 600 of FIG. 6) and/or a processor (e.g., central processing unit 606 of FIG. 6).

Method 500 begins with 502 and continues with 504 where a proximity sensor (e.g., proximity sensor 116 of FIG. 1) detects when the shipping container comes in proximity to a sensor system (e.g., sensor system 106 of FIG. 1). The term "proximity", as used here, may refer to a pre-defined distance between a leading edge (e.g., leading edge 140 of FIG. 1) of the shipping container and an axis (e.g., axis 150 of FIG. 1) of the sensor system, or to a presence of the shipping container within an area or at a location on the packaging station. The pre-defined distance can be selected in accordance with a given application. For example, the pre-defined distance is 1-10 feet, ≤10 feet, ≤5 feet, ≤2 feet, ≤1 foot or ≤10 inches.

Next in 506, the computing device (e.g., computing device 132 of FIG. 1) detects a trigger event. The trigger event can include, but is not limited to, an alignment of a center of the shipping container with the axis of the sensor system. This detection can be made in a variety of ways. One such technique using depth measurements of the shipping container's leading and training edges (e.g., leading and trailing edges 140, 142) is discussed above in relation to FIG. 1. This technique can be employed here to determine a time t when the shipping container's center will be aligned with the axis of the sensor system.

A sensor of the sensor system is enabled or otherwise activated in 508 so that sensor data is generated thereby at time t. The sensor can include, but is not limited to, a ToF camera, a lidar sensor, a radar sensor, and/or other sensor capable of generating sensor data that can be used to produce a 3D point cloud. The ToF camera provides a point cloud topography and visual light image. The 3D point cloud for an internal cavity of the shipping container is generated in 510. The 3D point cloud provides a surface map for the exposed interior sidewall surfaces of the shipping container and/or the exposed surfaces of any items disposed inside the shipping container.

The computing device analyzes the 3D point cloud in 512 to identify a void area (e.g., void area 202 of FIG. 2 or 302 of FIG. 3) inside the shipping container. A cubic volume V is computed for the void area in block 514. If the cubic volume V is not large enough to be filled with a minimal amount of protective packaging [516: NO], then method 500 continues with 518 where the shipping container is caused to travel towards a downstream container closer/sealer device (e.g., device 126 of FIG. 1) without any protective packaging being dispensed therein. Method 500 then continues to block 542 of FIG. 5B, which will be discussed below.

If the cubic volume V is large enough to be filled with a minimal amount of protective packaging [516: YES], then method 500 continues with operations of optional blocks 520-526. These optional operations 520-526 involve: segmenting the void area; detecting a type of item disposed in the shipping container; selecting, for the void area or each segment (e.g., void area section 204 of FIG. 2, 206 of FIG. 2, 208 of FIG. 2, 304 of FIG. 3, 306 of FIG. 3, 308 of FIG. 3 or 310 of FIG. 3), a protective packaging type based on its cubic volume and/or the associated item type; and/or selecting, for the void area or each segment, a percentage thereof that is to be filled with protective packaging based on its cubic volume and/or associated item type. Any known or to be known object detection technique can be employed in block 522. For example, a machine learning algorithm can be used that is trained to detect certain types of objects based on sensor data including 3D point cloud data. The machine learning algorithm can include, but is not limited to, a neural network. Database querying could also be employed using, for example, scanner data (e.g., barcode data).

Figure 5B:
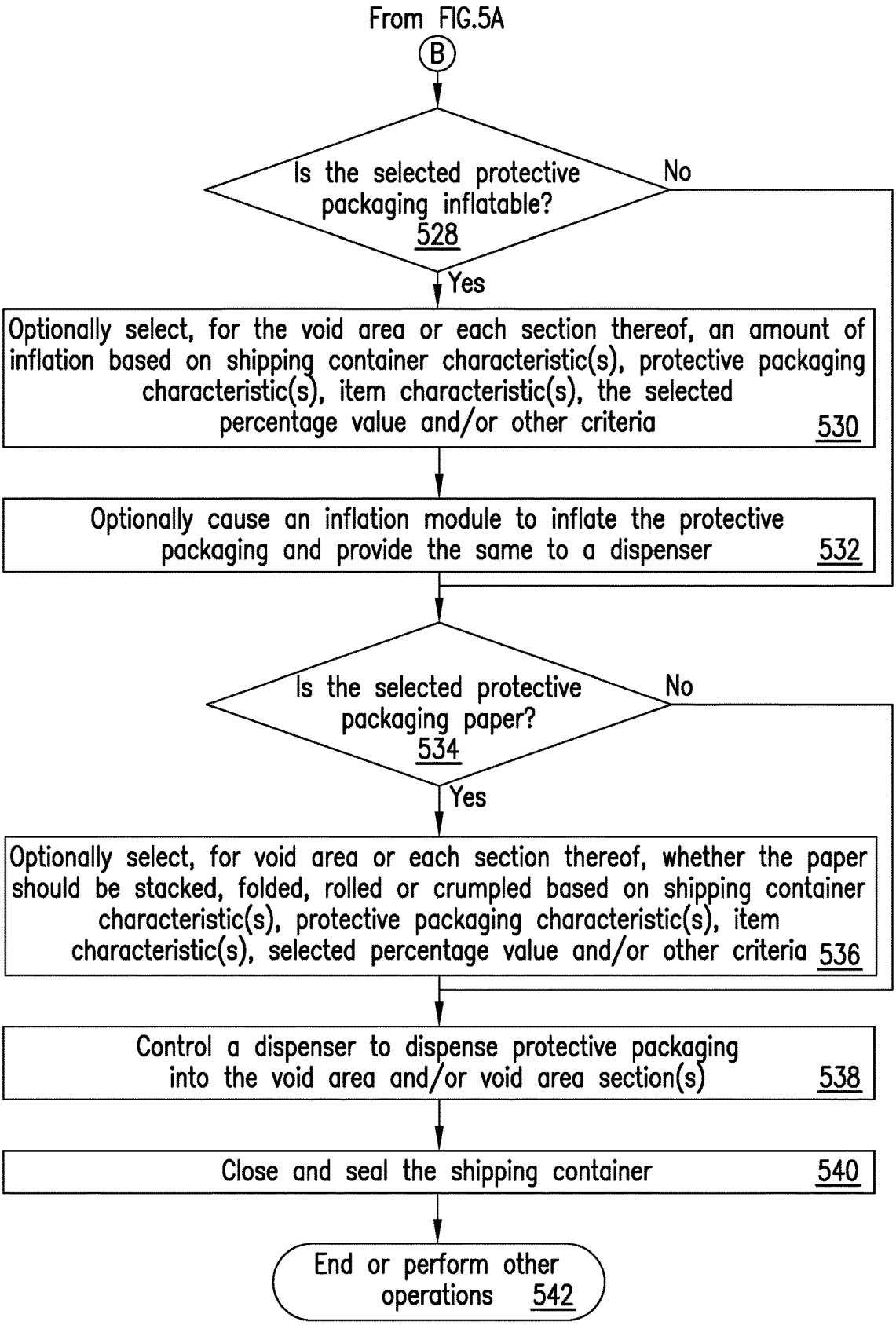

Upon completing 516 or the optional operations, method 500 continues with 528 of FIG. 5B. As shown in FIG. 5B, 528 involves determining whether the selected protective packaging is inflatable. Inflatable protective packaging can include, but are not limited to, cushions, pillows and/or bladders. If the selected protective packaging is not inflatable [528: NO], then method 500 continues to 534 which will be discussed below. In contrast, if the protective-packaging is inflatable [528: YES], then method 500 continues with operations of optional blocks 530, 532. The optional operations involve: selecting, for the void area or each segment thereof, an amount of inflation based on certain criteria; and/or causing an inflation module (e.g., inflation module 160 of FIG. 1) to inflate the shipping material and provide the same to a dispenser (e.g., dispenser 118 of FIG. 1). The criteria on which the selection of block 520 is made can include, but is not limited to, shipping container characteristic(s), protective-packaging characteristic(s), item characteristic(s), the selected percentage value and/or other criteria. The shipping container characteristics can include, for example, type and/or size. The protective-packaging articles characteristics can include, for example, type and/or size. The item characteristics can include, but are not limited to, type, size, and/or fragility.

In decision block 534, the computing device determines whether the selected protective-packaging is paper dunnage. If not [534: NO], then method 500 continues to 538 which will discussed below. If so [534: YES], then method 500 continues with operations of optional block 536 or block 538. Block 536 involves optionally selecting, for the void area or each segment thereof, whether the paper should be folded or crumpled based on certain criteria. The criteria can be the same as or different than the criteria used to make the selection in block 530. Thus, the criteria used in block 536 can include, but is not limited to, shipping container characteristic(s), protective-packaging characteristic(s), item characteristic(s), the selected percentage value and/or other criteria.

In block 538, the computing device controls autonomous operations of dispenser(s) (e.g., dispenser(s) 118, 122 of FIG. 1) to cause shipping material to be dispensed into the void area and/or void area section(s). The autonomous operations can include, but are not limited to, actuating motors, actuating belts, actuating wheels, enabling air vectoring, opening valves, actuating latches, actuating a telescoping shaft, articulating arm(s), and/or moving joint(s).

Air knives or other suitable mechanisms may be used to steer inflatable protective-packaging, such as cushions, pillows and bladders, into the shipping container. Articulating steering vanes of polymeric or metal material may also be used to steer the inflatable protective-packaging into the shipping container. A chute may be provided from the dispenser, with drive belts on each side of the chute for inserting the units of inflatable protective-packaging into the appropriate portion of the shipping container. The insertion point for any of the above transport mechanisms can be manipulated to the correct spot within the shipping container by, for example, moving an insertion funnel linearly (e.g., upwardly, downwardly, or sideways), or at an angle. For containment of the protective packaging units once they are inserted, the transport mechanisms can use brushes, a set of elastomeric strands spanning the top of the shipping container (thereby allowing the inflatable protective-packaging to be pushed through but not to rebound or drift back out); or the flaps of the shipping container itself, to help contain the shipping material inside the shipping container. In addition to or in place of a containment mechanism, the deposition area may be isolated from the environment to avoid air currents that could prevent the inflatable protective-packaging from reaching their target zones, or that could displace the inflatable protective-packaging afterward.

Paper dunnage and inflatable protective-packaging, such as cushions, pillows and bladders, can be inserted by a variety of drive mechanisms, or channeled through a chute with an articulating head. For example, paper dunnage or inflatable protective-packaging can be conveyed by parallel drive belts on the side of a chute, by elastomeric drive wheels. The drive wheels could be articulated in a fashion to steer the paper dunnage or inflatable protective-packaging laterally. In the case of paper dunnage, such articulation can create a lateral crease in the crumpled paper web that allows for the paper dunnage to lace back and forth into the shipping container. The insertion point of the paper dunnage or inflatable protective-packaging can be manipulated to the correct spot in the shipping container by either moving the insertion funnel linearly (e.g., upwardly, downwardly, sideways), or at an angle. The amount of paper dunnage or inflatable protective-packaging is determined by the void volume, subdivided into the smaller zone for precise of dunnage or inflatable protective-packaging to void ratios.

The shipping container is closed and sealed in 540. Subsequently, 542 is performed where method 500 ends or other operations are performed. Typically, shipping labels are printed and attached to packaging at this stage.

Figure 6:
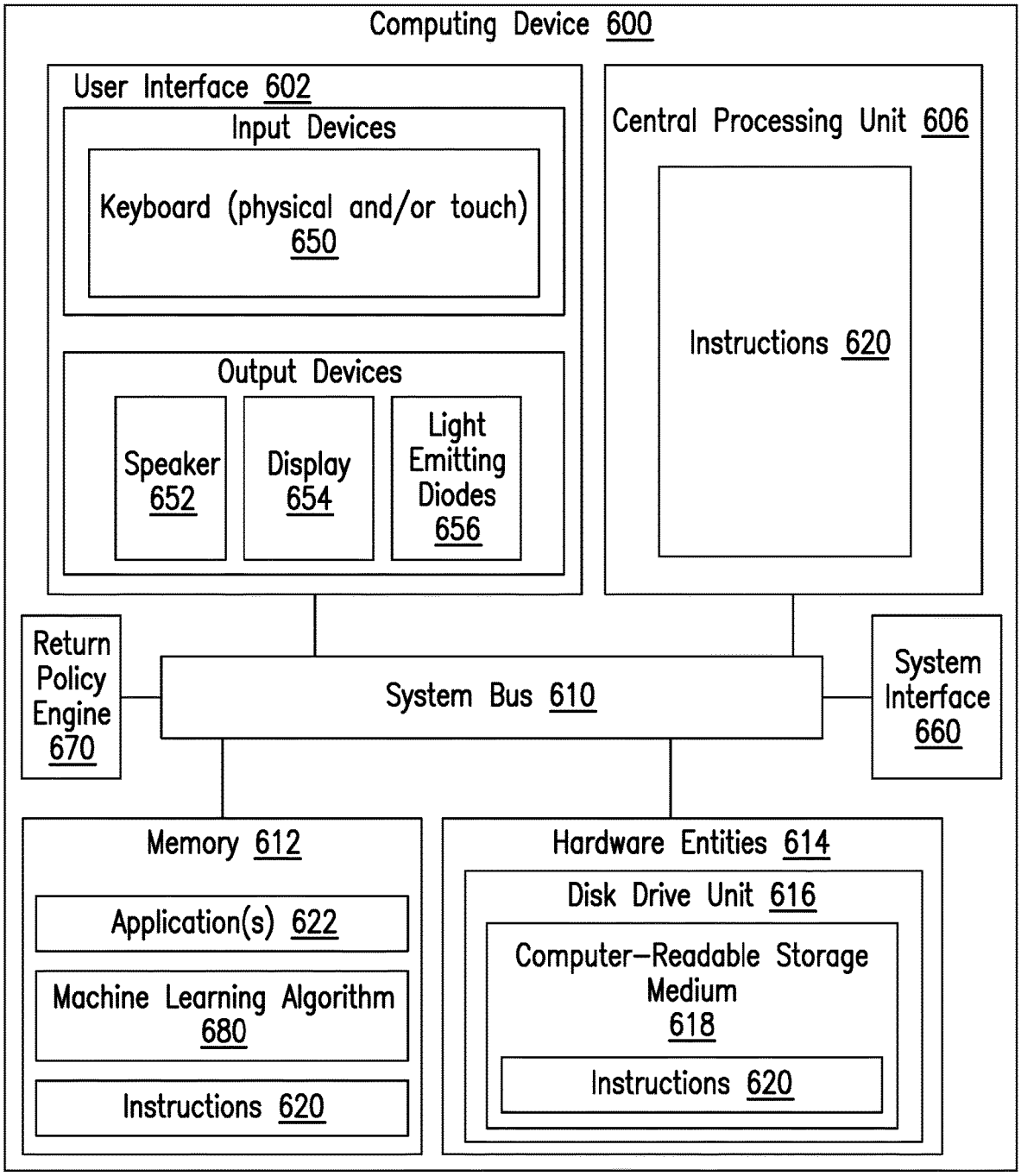
FIG. 6 provides an illustration of a computing device.

Referring now to FIG. 6, there is provided an illustration of a computing device 600. Sensor system 106 of FIG. 1, computing device 132 of FIG. 1, and/or controller 190 of FIG. 1 is(are) the same as or similar to computing device 600. As such, the discussion of computing device 600 is sufficient for understanding these component of system 100.

In some scenarios, the present solution is used in a client-server architecture. Accordingly, the computing device architecture shown in FIG. 6 is sufficient for understanding the particulars of client computing devices and servers.

Computing device 600 may include more or less components than those shown in FIG. 6. However, the components shown are sufficient to disclose an illustrative solution implementing the present solution. The hardware architecture of FIG. 6 represents one implementation of a representative computing device configured to provide an improved item return process, as described herein. As such, the computing device 600 of FIG. 6 implements at least a portion of the method(s) described herein.

Some or all components of the computing device 600 can be implemented as hardware, software and/or a combination of hardware and software. The hardware includes, but is not limited to, one or more electronic circuits. The electronic circuits can include, but are not limited to, passive components (e.g., resistors and capacitors) and/or active components (e.g., amplifiers and/or microprocessors). The passive and/or active components can be adapted to, arranged to and/or programmed to perform one or more of the methodologies, procedures, or functions described herein.

As shown in FIG. 6, the computing device 600 comprises a user interface 602, a Central Processing Unit ("CPU") 606, a system bus 610, a memory 612 connected to and accessible by other portions of computing device 600 through system bus 610, a system interface 660, and hardware entities 614 connected to system bus 610. The user interface can include input devices and output devices, which facilitate user-software interactions for controlling operations of the computing device 600. The input devices include, but are not limited, a physical and/or touch keyboard 650. The input devices can be connected to the computing device 600 via a wired (serial or Wired LAN) or wireless connection (e.g., a Bluetooth® connection or WiFi connection). The output devices include, but are not limited to, a speaker 652, a display 654, and/or light emitting diodes 656. System interface 660 is configured to facilitate wired or wireless communications to and from external devices (e.g., network nodes such as access points, etc.).

At least some of the hardware entities 614 perform actions involving access to and use of memory 612, which can be a Radom Access Memory ("RAM"), a disk driver, a Compact Disc Read Only Memory ("CD-ROM") or remote "cloud" based processing. Hardware entities 614 can include a disk drive unit 616 comprising a computer-readable storage medium 618 on which is stored one or more sets of instructions 620 (e.g., software code) configured to implement one or more of the methodologies, procedures, or functions described herein. The instructions 620 can also reside, completely or at least partially, within the memory 612 and/or within the CPU 606 during execution thereof by the computing device 600. The memory 612 and the CPU 606 also can constitute machine-readable media. The term "machine-readable media", as used here, refers to a single medium or multiple media (e.g., a centralized or distributed database, and/or associated caches and servers) that store the one or more sets of instructions 620. The term "machine-readable media", as used here, also refers to any medium that is capable of storing, encoding or carrying a set of instructions 620 for execution by the computing device 600 and that cause the computing device 600 to perform any one or more of the methodologies of the present disclosure.

Although the present solution has been illustrated and described with respect to one or more implementations, equivalent alterations and modifications will occur to others skilled in the art upon the reading and understanding of this specification and the annexed drawings. In addition, while a particular feature of the present solution may have been disclosed with respect to only one of several implementations, such feature may be combined with one or more other features of the other implementations as may be desired and advantageous for any given or particular application. Thus, the breadth and scope of the present solution should not be limited by any of the above described embodiments. Rather, the scope of the present solution should be defined in accordance with the following claims and their equivalents.

Without excluding further possible embodiments, certain example embodiments are summarized in the following clauses:

Clause 1: A method for packing a shipping container, comprising: detecting, by a computing device, a presence of the shipping container; generating, by a computing device, a 3D point cloud comprising a 3D perspective representation of interior of the shipping container and surfaces of at least one item disposed in the shipping container; analyzing, by a computing device, the 3D point cloud to identify a void area inside the shipping container, the void area being absent of the at least one item; selecting, by the computing device, a percentage from a plurality of possible percentages based on a characteristic of the void area; and causing, by the computing device, protective packaging to be dispensed into the void area such that the selected percentage of the void area is filled with the protective packaging.

Clause 2: The method of clause 1, wherein the shipping container comprises a box, a bag or an envelope or padded mailer envelope.

Clause 3: The method according to any of the preceding method clauses, further comprising: dividing the void area into void area sections; and selecting different percentages from the plurality of possible percentages for at least two of the void area sections based on characteristics of the void area sections.

Clause 4: The method according to any of the preceding method clauses, wherein the characteristics of the void area sections comprise at least one of cubic volumes, relative locations of the void area sections to each other, and relative locations of the void area sections to the at least one item disposed in the shipping container.

Clause 5: The method according to any of the preceding method clauses, wherein a cubic volume of a void area has a non-linear relationship to a percentage of the void area that is to be filled with protective packaging.

Clause 6: The method according to any of the preceding method clauses, further comprising: detecting, by the computing device, occurrence of a trigger event; and enabling a sensor responsive to the trigger event.

Clause 7: The method according to any of the preceding method clauses, wherein the trigger event comprises an alignment of a center of the shipping container with an axis of the sensor.

Clause 8: The method according to any of the preceding method clauses, wherein detection of the trigger event is based on a depth measurement for at least one edge of the shipping container.

Clause 9: The method according to any of the preceding method clauses, further comprising computing a cubic volume of the void area.

Clause 10: The method according to any of the preceding method clauses, wherein the characteristic of the void area comprises the cubic volume.

Clause 11: The method according to any of the preceding method clauses, further comprising causing the shipping container to be closed and sealed without any protective packaging being dispensed therein, when the cubic volume is not large enough to be filled with a threshold amount of protective packaging.

Clause 12: The method according to any of the preceding method clauses, wherein the causing protective packaging to be dispensed into the void area is performed when the cubic volume is large enough to be filled with a threshold amount of protective packaging.

Clause 13: The method according to any of the preceding method clauses, further comprising selecting a protective packaging type from a plurality of possible protective packaging types based on the cubic volume or a type of the at least one item, when the cubic volume is large enough to be filled with the threshold amount of protective packaging.

Clause 14: The method according to any of the preceding method clauses, wherein the plurality of protective packaging types comprises at least inflatable cushions, packing paper or foam in place.

Clause 15: The method according to any of the preceding method clauses, further comprising selecting an amount of inflation from a plurality of possible inflation amounts when the selected protective-packaging type comprises an inflatable protective packaging.

Clause 16: The method according to any of the preceding method clauses, wherein the amount of inflation is selected based on at least one of a characteristic of the shipping container, a characteristic of the protective-packaging, a characteristic of the at least one item disposed in the shipping container, and the percentage which was selected.

Clause 17: The method according to any of the preceding method clauses, further comprising causing an inflation module to inflate the shipping material by the selected amount of inflation.

Clause 18: The method according to any of the preceding method clauses, further comprising selecting whether the shipping material should be wrapped, stacked, folded, rolled or crumpled when the selected protective-packaging type comprises packing paper.

Clause 19: The method according to any of the preceding method clauses, wherein a selection is made as to whether the shipping material should be wrapped, stacked, folded, rolled or crumpled based on at least one of a characteristic of the shipping container, a characteristic of the protective-packaging, a characteristic of the at least one item disposed in the shipping container, and the percentage which was selected.

Clause 20: A system, comprising: a processor; and a non-transitory computer-readable storage medium comprising programming instructions that are configured to cause the processor to implement a method for packing a shipping container, wherein the programming instructions comprise instructions to: detect presence of the shipping container; generate a 3D point cloud comprising a 3D perspective representation of interior of the shipping container and surfaces of at least one item disposed in the shipping container; analyze the 3D point cloud to identify a void area inside the shipping container, the void area being absent of the at least one item; select a percentage from a plurality of possible percentages based on a characteristic of the void area; and cause protective packaging to be dispensed into the void area such that the selected percentage of the void area is filled with protective packaging.

Clause 21: A non-transitory computer-readable medium that stores instructions that, when executed by at least one computing device, will cause the at least one computing device to perform operations comprising: detecting a presence of the shipping container; generating a 3D point cloud comprising a 3D perspective representation of interior of the shipping container and surfaces of at least one item disposed in the shipping container; analyzing the 3D point cloud to identify a void area inside the shipping container, the void area being absent of the at least one item; selecting a percentage from a plurality of possible percentages based on a characteristic of the void area; and causing protective packaging to be dispensed into the void area such that the selected percentage of the void area is filled with protective packaging.

The breadth and scope of this disclosure should not be limited by any of the above-described example embodiments, but should be defined only in accordance with the following claims and their equivalents.

What is claimed is:

1. A method for packing a shipping container, comprising:

detecting, by a computing device, a presence of the shipping container;

generating, by a computing device, a 3D point cloud comprising a 3D perspective representation of interior of the shipping container and surfaces of at least one item disposed in the shipping container;

analyzing, by a computing device, the 3D point cloud to identify one or more void areas inside the shipping container, the one or more void areas being absent of the at least one item;

dividing at least a first void area of the void areas into a plurality of void area sections;

selecting, by the computing device based on characteristics of the plurality of void area sections, a first percentage from a plurality of possible percentages for a first void area section of the plurality of void area sections and a different second percentage from the plurality of possible percentages for a second void area section of the plurality of void area sections, wherein each of the first and second percentages represents an amount of a void area volume that should be filled with protective packaging; and causing, by the computing device, the protective packaging to be dispensed into the one or more void areas such that the selected first percentage of the first void area section is filled with the protective packaging and the selected different second percentage of the second void area section is filled with the protective packaging.

2. The method according to claim 1, wherein the shipping container comprises a box, a bag or an envelope or padded mailer envelope.

3. The method according to claim 1, wherein the first void area section has a cubic volume different than a cubic volume of the second void area section.

4. The method according to claim 1, wherein the characteristics of the plurality of void area sections comprise at least one of cubic volumes, relative locations of the void area sections to each other, and relative locations of the plurality of void area sections to the at least one item disposed in the shipping container.

5. The method according to claim 1, further comprising:

detecting, by the computing device, occurrence of a trigger event; and enabling a sensor responsive to the trigger event.

6. The method according to claim 5, wherein the trigger event comprises an alignment of a center of the shipping container with an axis of the sensor.

7. The method according to claim 6, wherein detection of the trigger event is based on a depth measurement for at least one edge of the shipping container.

8. The method according to claim 1, further comprising computing a cubic volume of each of the one or more void areas.

9. The method according to claim 8, further comprising computing a cubic volume of each of the plurality of void area sections.

10. The method according to claim 8, further comprising causing the shipping container to be closed and sealed without any protective packaging being dispensed therein, when the cubic volume is not large enough to be filled with a threshold amount of protective packaging.

11. The method according to claim 8, wherein the causing protective packaging to be dispensed into the one or more void areas is performed when the cubic volume is large enough to be filled with a threshold amount of protective packaging.

12. The method according to claim 8, further comprising selecting a protective packaging type from a plurality of possible protective packaging types based on the cubic volume or a type of the at least one item, when the cubic volume is large enough to be filled with the threshold amount of protective packaging.

13. The method according to claim 12, wherein the plurality of protective packaging types comprises at least inflatable cushions, packing paper or foam in place.

14. The method according to claim 12, further comprising selecting an amount of inflation from a plurality of possible inflation amounts when the selected protective-packaging type comprises an inflatable protective packaging.

15. The method according to claim 14, wherein the amount of inflation is selected based on at least one of a characteristic of the shipping container, a characteristic of the protective-packaging, a characteristic of the at least one item disposed in the shipping container, and at least one of the first and second percentages which were selected.

16. The method according to claim 14, further comprising causing an inflation module to inflate the shipping material by the selected amount of inflation.

17. The method according to claim 12, further comprising selecting whether the shipping material should be wrapped, stacked, folded, rolled or crumpled when the selected protective-packaging type comprises packing paper.

18. The method according to claim 17, wherein a selection is made as to whether the shipping material should be wrapped, stacked, folded, rolled or crumpled based on at least one of a characteristic of the shipping container, a characteristic of the protective-packaging, a characteristic of the at least one item disposed in the shipping container, and at least one of the first and second percentages which were selected.

19. The method according to claim 1, wherein each of the first and second percentages represents a minimal amount of a void area volume that should be filled with protective packaging.

20. The method according to claim 1, further comprising dispensing the protective packaging into the first void area section.

21. The according to claim 20, further comprising dispensing the protective packaging into the second void area section.

22. A system, comprising:

a processor;

a non-transitory computer-readable storage medium comprising programming instructions that are configured to cause the processor to implement a method for packing a shipping container, wherein the programming instructions comprise instructions to:

detect presence of the shipping container;

generate a 3D point cloud comprising a 3D perspective representation of interior of the shipping container and surfaces of at least one item disposed in the shipping container;

analyze the 3D point cloud to identify one or more void areas inside the shipping container, the one or more void areas being absent of the at least one item;

divide at least a first void area of the one or more void areas into a plurality of void area sections;

select, based on characteristics of the plurality of void area sections, a first percentage from a plurality of possible percentages for a first void area section of the plurality of void area sections and a different second percentage from the plurality of possible percentages for a second void area section of the plurality of void area sections, wherein each of the first and second percentages represents an amount of a void area volume that should be filled with protective packaging; and cause the protective packaging to be dispensed into the one or more void areas such that the selected first percentage of the first void area section is filled with protective packaging and the selected different second percentage of the second void area section is filled with the protective packaging.

23. The system according to claim 22, further comprising a dispenser configured to dispense the protective packaging into the one or more void areas such that the selected first percentage of the first void area section is filled with protective packaging and the selected different second percentage of the second void area section is filled with the protective packaging.

24. A non-transitory computer-readable medium that stores instructions that, when executed by at least one computing device, will cause the at least one computing device to perform operations comprising:

detecting a presence of the shipping container;

generating sensor data comprising a multi-dimensional representation of interior of the shipping container and surfaces of at least one item disposed in the shipping container;

analyzing the sensor data to identify one or more void areas inside the shipping container, the void area being absent of the at least one item;

dividing at least a first void area of the void areas into a plurality of void area sections;

selecting, based on characteristics of the plurality of void area sections, a first percentage from a plurality of possible percentages for a first void area section of the plurality of void area sections and a different second percentage from the plurality of possible percentages for a second void area section of the plurality of void area sections, wherein each of the first and second percentages represents an amount of a void area volume that should be filled with protective packaging; and causing the protective packaging to be dispensed into the one or more void areas such that the selected first percentage of the first void area section is filled with protective packaging and the selected different second percentage of the second void area section is filled with the protective packaging.

25. The non-transitory computer-readable medium according to claim 24, wherein the sensor data comprises a 3D point cloud.

* * * * *